US011306616B2

(12) United States Patent
Lefebvre et al.

(10) Patent No.: US 11,306,616 B2
(45) Date of Patent: Apr. 19, 2022

(54) MECHANICAL ARRANGEMENT FOR JOINING ENGINE COMPONENTS

(71) Applicant: PRATT & WHITNEY CANADA CORP., Longueuil (CA)

(72) Inventors: Guy Lefebvre, St-Bruno-de-Montarville (CA); Francois Doyon, Ste-Julie (CA); Remy Synnott, St-Jean-sur Richelieu (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 86 days.

(21) Appl. No.: 16/744,531

(22) Filed: Jan. 16, 2020

(65) Prior Publication Data

US 2021/0222589 A1 Jul. 22, 2021

(51) Int. Cl.
*F01D 25/24* (2006.01)

(52) U.S. Cl.
CPC ..... *F01D 25/243* (2013.01); *F05D 2230/232* (2013.01); *F05D 2230/60* (2013.01); *F05D 2240/50* (2013.01)

(58) Field of Classification Search
CPC ..... F01D 25/243; F05D 2230/232; F05D 2230/60; F05D 2240/50
USPC ..... 415/214.1
See application file for complete search history.

(56) References Cited

U.S. PATENT DOCUMENTS

| | | | | |
|---|---|---|---|---|
| 10,208,622 | B2 | 2/2019 | Grant et al. | |
| 10,415,481 | B2 | 9/2019 | Grogg et al. | |
| 2009/0293253 | A1* | 12/2009 | Walker | B23P 6/005 29/402.13 |
| 2016/0003161 | A1* | 1/2016 | Grogg | F02C 7/20 415/177 |
| 2016/0201490 | A1* | 7/2016 | Scott | F01D 25/30 415/213.1 |
| 2016/0258322 | A1* | 9/2016 | Winn | F01D 25/145 |

FOREIGN PATENT DOCUMENTS

JP H0519625 U * 3/1993

* cited by examiner

*Primary Examiner* — Yi-Kai Wang
(74) *Attorney, Agent, or Firm* — Norton Rose Fulbright Canada LLP

(57) ABSTRACT

A turbine exhaust case assembly has an exhaust case and a bearing housing mounted in the exhaust case. A plurality of fasteners secures the bearing housing to the exhaust case. A spacer is mounted between the fasteners and one of the bearing housing and the exhaust case. The fasteners are welded to the spacer, thereby locking the fasteners against rotation.

18 Claims, 7 Drawing Sheets

MECHANICAL ARRANGEMENT FOR JOINING ENGINE COMPONENTS

TECHNICAL FIELD

The disclosure relates generally to a mechanical arrangement for joining engine components, such as a bearing housing and a turbine exhaust case.

BACKGROUND

Welding of metal parts together is a common method of making a permanent connection. Access for manual welding may be physically difficult and may yield inconsistent results. Automated welding from one side often requires access to the opposite side of the welded joint to machine away excess weld consumable material. The heat used in welding may cause undesirable changes in metal material properties, thermally induced distortion, surface finishes and coatings.

SUMMARY

The disclosure describes a turbine exhaust case assembly comprising: an exhaust case; a bearing housing mounted in the exhaust case; a plurality of fasteners securing the bearing housing to the exhaust case; a spacer mounted between the plurality of fasteners and one of the bearing housing and the exhaust case; and at least one weld between the plurality of the fasteners and the spacer, the at least one weld locking the fasteners against rotation.

In a further aspect the disclosure describes turbine exhaust case assembly comprising: an exhaust case having a plurality of through bores aligned on a plurality of fastener axes in a circumferentially spaced apart array; a bearing housing having a plurality of threaded bores aligned on the fastener axes; a plurality of fasteners, each fastener having a head engaging the exhaust case, a shank extending through the through bore, and a threaded end engaging the threaded bore for connecting and disconnecting the exhaust case and the bearing housing when the head is rotated; and an anti-rotation device securing the head of each fastener to the exhaust case.

In a further aspect the disclosure describes a method for connecting an exhaust case and a bearing housing of a gas turbine engine, the method comprising: positioning the bearing housing in the exhaust case using spigot connection, fastening the bearing housing to the exhaust case using a plurality of threaded fasteners, and securing the plurality of threaded fasteners against rotation.

Embodiments can include combinations of the above features.

Further details of these and other aspects of the subject matter of this application will be apparent from the detailed description included below and the drawings.

DETAILED DESCRIPTION

Figure 1:
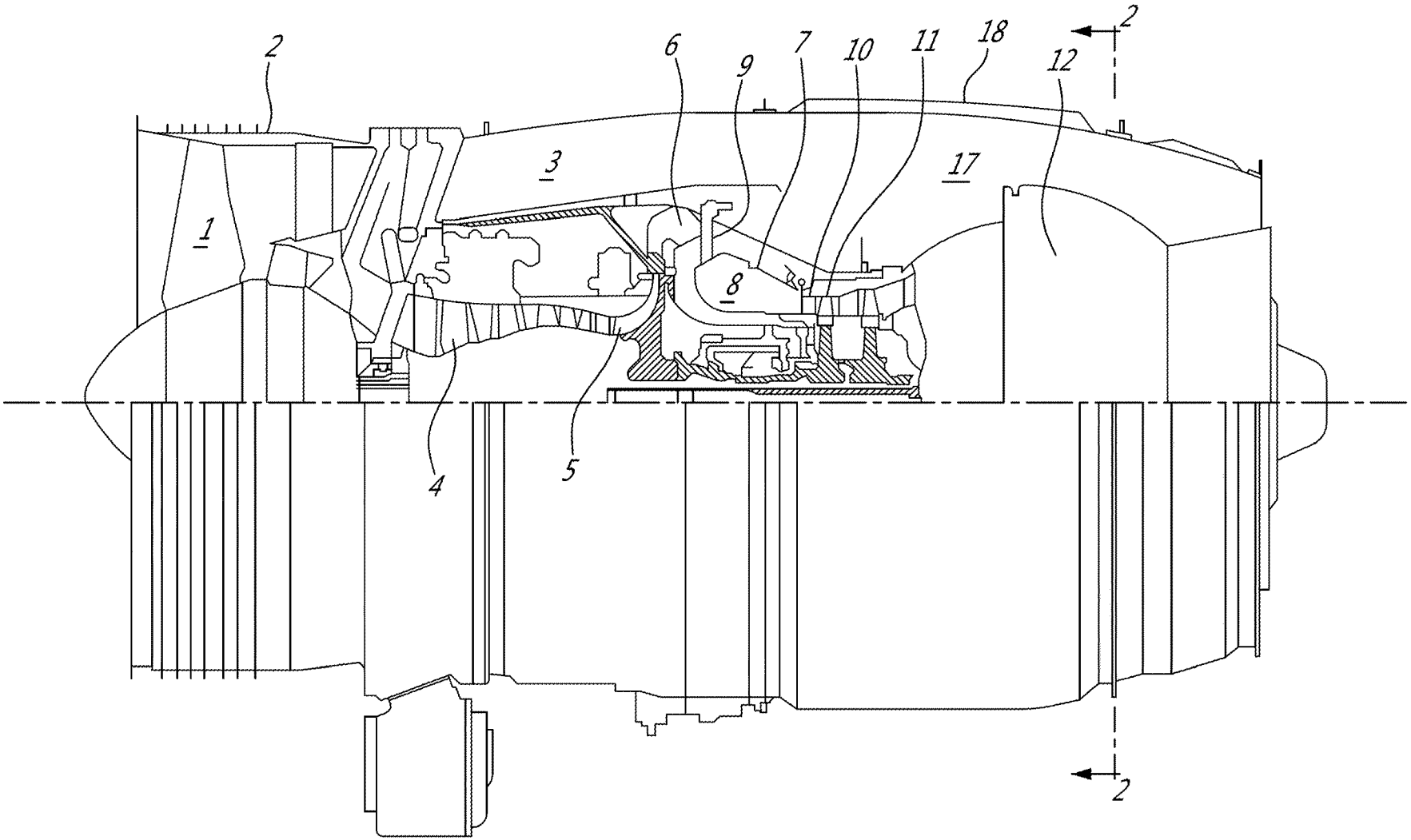
FIG. 1 shows an axial cross-section view of a turbo-fan gas turbine engine.

FIG. 1 shows an axial cross-section through an aircraft engine. According to the illustrated embodiment, the aircraft engine is a turbo-fan gas turbine engine. However, it is understood that the aircraft engine could adopt various other forms. For instance, the engine could be a turboshaft, a turboprop or a compounded engine. Air intake into the engine passes over fan blades 1 in a fan case 2 and is then split into an outer annular flow through the bypass duct 3 and an inner flow through the low-pressure axial compressor 4 and high-pressure centrifugal compressor 5. Compressed air exits the compressor through a diffuser 6 and is contained within a plenum 7 that surrounds the combustor 8. Fuel is supplied to the combustor 8 through fuel nozzles 9 and fuel is mixed with air from the plenum 7 when sprayed through nozzles into the combustor 8 as a fuel air mixture that is ignited. A portion of the compressed air within the plenum 7 is admitted into the combustor 8 through orifices in the side walls to create a cooling air curtain along the combustor walls or is used for cooling the turbines to eventually mix with the hot gases from the combustor and pass over the nozzle guide vane 10 and turbine blades 11 before exiting the exhaust section 12 of the engine as exhaust.

Figure 2:
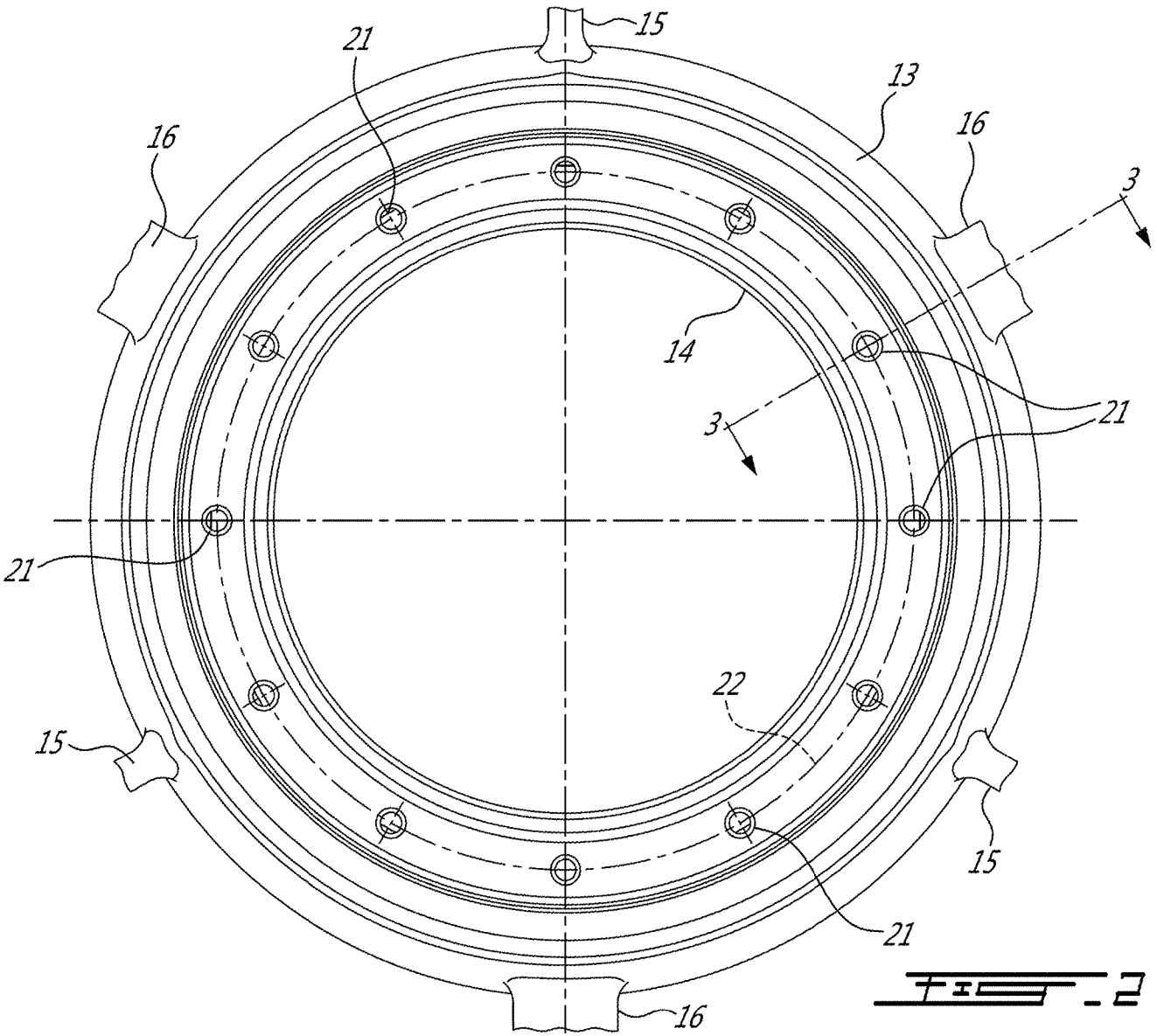
FIG. 2 shows a partial radial sectional view along line 2-2 of FIG. 1 to illustrate the frangible connection between the exhaust case and the bearing housing using bolts with anti-rotation devices.
Figure 3:
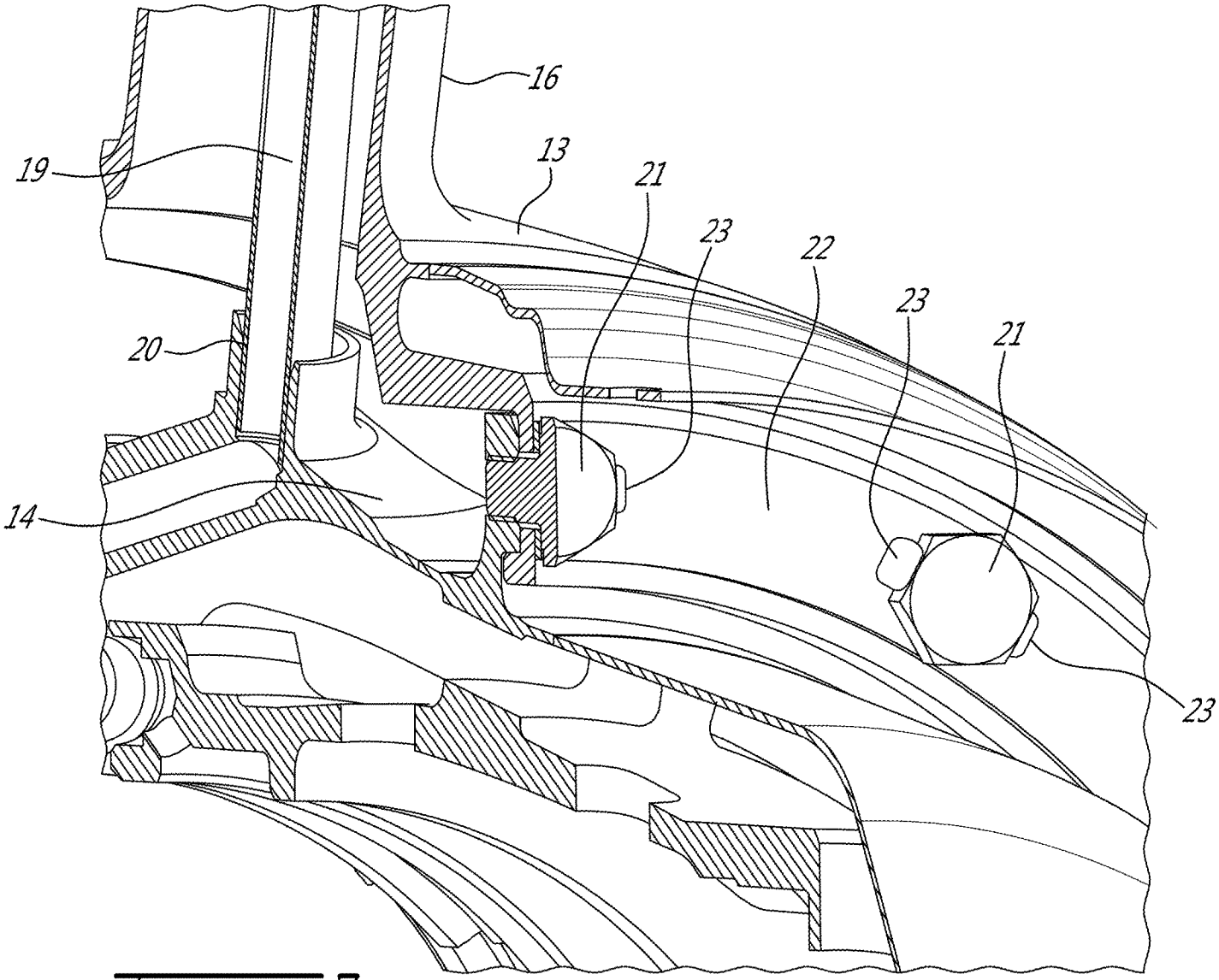
FIG. 3 is a partial axial isometric sectional view along line 3-3 of FIG. 2.

As shown in FIGS. 2 and 3, the engine exhaust section 12 generally comprises an exhaust case 13 and a bearing housing 14. The bearings require the supply of lubricating oil, cooling air, sensors and inspection access. The exhaust case 13 includes radially extending struts 16 that have an exterior airfoil shape with a hollow interior that can be used to route supply tubes (such as tube 19 in FIG. 3) from an exterior supply to the inner bearing housing 14. The supply tubes can be brazed to the bearing housing 14 in an oven or assembly fixture. While permitting the use of a thinner improved aerodynamic shape for the struts 16, the permanent brazing of supply tubes also prevents the exhaust case 13 from being disassembled from the bearing housing 14. The bearing housing 14 can be welded to the exhaust case 13 to prevent disassembly and to eliminate the risk of damaging the supply tubes. However, in some applications, the available space may not allow welding.

Furthermore, to allow inspection, repair and replacement of parts, it is generally preferred that assembled components can be disassembled. On the other hand, rigid reliable connections are needed when assembled components are exposed to high heat, stress, vibration, corrosion and other demanding operating environments. Alternatives are thus desirable.

As will be seen herein after, FIGS. 2 to 5 illustrate an example of a mechanical arrangement to fasten the bearing housing 14 in the exhaust case 13 by using mechanical fasteners (e.g. bolts, shoulder pins, rivets, etc.) joined to a sacrificial part (e.g. a spacer) with anti-rotation welds or the like.

Figure 4:
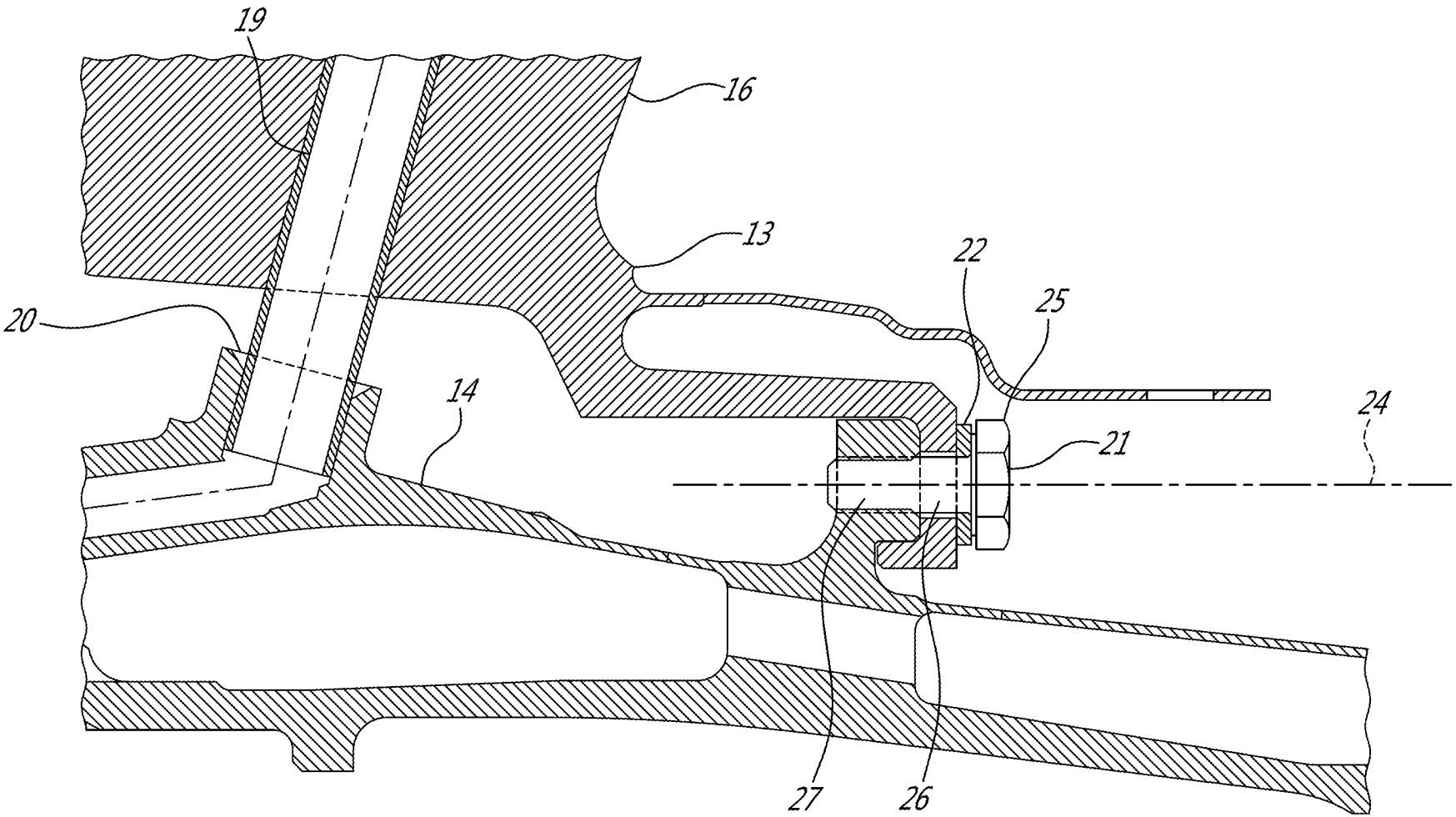
FIG. 4 is a like axial sectional view showing the bolted connection between the inner bearing housing, outer exhaust case, hollow strut and supply tube.

According to the illustrated exemplary embodiment, the exhaust case 13 has three narrow struts 15 and three wide struts 16 that span across the exhaust stage of the hot gas path 17 (FIG. 1). The struts 15, 16 structurally connect the exhaust case 13 to the outer wall 18 of the hot gas path 17. The wide struts 16 are hollow airfoil shapes that contain supply tubes 19 as seen in FIGS. 3-4. As best seen in FIG. 4, the supply tube 19 can supply oil or air to the bearing housing 14, for example.

Figure 5:
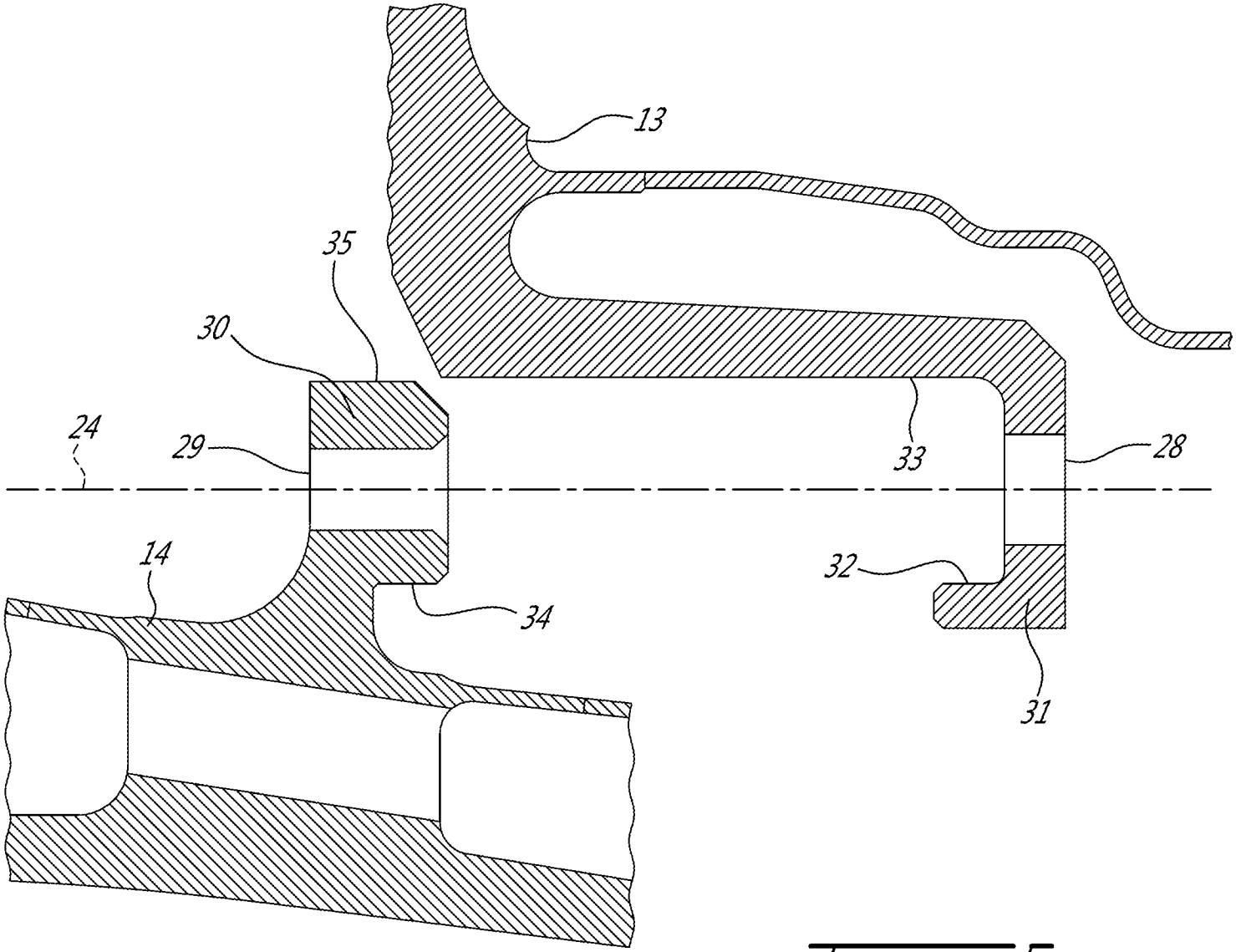
FIG. 5 is an exploded axial sectional view with the bolt removed and separated bearing housing and exhaust case.

As shown in FIG. 5, the bearing housing 14 is positioned on the exhaust case 13 using a spigot joint including spigot diameters 32, 34. More particularly, the bearing housing 14 has a radially outer annular flange 30 with multiple threaded bores 29. The exhaust case 13 includes a corresponding radially inner annular flange 31 with a same pattern of through bores 28. The through bores 28 and the threaded bores 29 are configured to align on respective fastener axes 24. To align the exhaust case 13 and bearing housing 14, the flanges 30, 31 are axially press fit together. The exhaust case 13 has an inner spigot diameter surface 32 and an outer spigot diameter surface 33. The bearing housing 14 has an inner spigot diameter surface 34 and an outer spigot diameter surface 35 configured to mate with the exhaust case spigot surfaces 32, 33, respectively. FIG. 4 shows the completed assembly with spigot surfaces 32-35 engaged.

Once the bearing housing 14 has been properly positioned in the exhaust case 13 as described herein above, the service tubes 19 are inserted in the bearing housing 14. The joint 20 between each tube 19 and the bearing housing 14 is brazed. Braze paste or braze shim can be used to form joint 20. The assembly is then temporarily maintained with a braze fixture, such as temporary bolts engaged in some of the aligned bores 28, 29, and the secured assembly is sent to a braze furnace. The temporary bolts are then removed from bores 28, 29 and a sacrificial part, such as a spacer ring 22 having the same bore pattern as the bearing housing 14 and the exhaust case 13 is provided on an axially facing surface of the radially inner flange 31 of the exhaust case 13 opposite to the bearing housing 14, as best shown in FIGS. 3 and 4.

Referring to FIGS. 2 to 4, the exhaust case 13, the bearing housing 14 and the spacer 22 are joined with a plurality of circumferentially spaced apart fasteners, bolts 21 in the example shown. Each bolt 21 has a head 25 engaging the spacer 22, a shank 26 extending through the through bore 28, and a threaded end 27 for threaded engagement with threaded bore 29 in the bearing housing 14. The bolts 21 are welded to the spacer 22 as a frangible anti-rotation measure.

FIGS. 3-4 show the assembled exhaust case 13, bearing housing 14, spacer 22 and welded bolts 21. FIG. 3 shows the tack weld 23 that connects the bolt 21, and more particularly the bolt head 25, to the spacer 22 and prevents rotation or loosening of the bolt 21 connection, thereby providing a bolted joint as a permanent assembly. In another aspect, the above combination of features provides for a spigot tight fit in a welded assembly. Having a spacer between the bolt heads 25 and the exhaust joint structure to weld the bolt heads 25 also allows preserving the exhaust case and bearing housing material integrity.

The weld 23 can be ground off, chiseled or gouged out to release the bolt 21, remove the spacer 22 and allow disassembly if need be. When the weld 23 is not present, rotation of the head 25 engages the threaded end 27 in the threaded bore 29 for connecting and disconnecting the exhaust case 13 and bearing housing 14. Other anti-rotation devices can be used, such as a rectangular block abutting the hexagonal head 25 of the bolt 21.

In the example shown in FIG. 3, the tack or short fillet weld 23 serves as the anti-rotation device securing the bolt head 25 of each fastener to the spacer 22. More particularly, in the example illustrated in FIGS. 2-6, the removable anti-rotation device comprises the annular spacer 22 connected to the head 25 of each fastener bolt 21 with a frangible connector, namely the fillet weld 23 which can be ground off, gouged or chiseled away.

Figure 7:
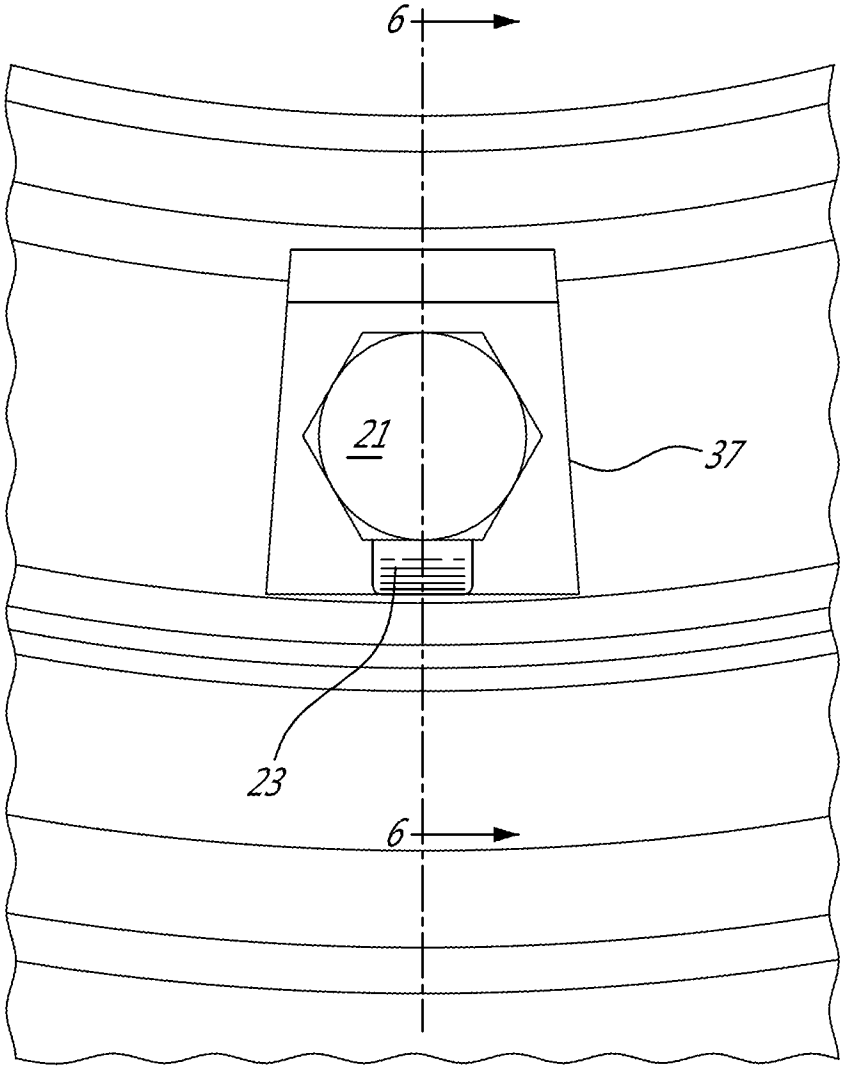
FIG. 7 shows a radial section (line 7-7 of FIG. 6) through the alternative assembly using a U-shaped clip.
Figure 6:
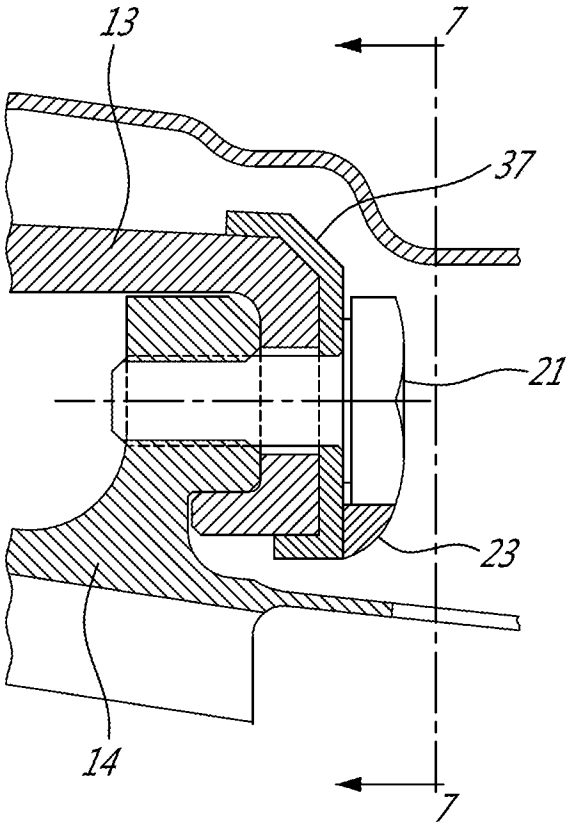
FIG. 6 shows an axial section (line 6-6 of FIG. 7) through an alternative assembly where a spacer in the form of a U-shaped clip is welded to the bolt head and engages the edges of the exhaust case to prevent rotation of the bolt.
Figure 8:
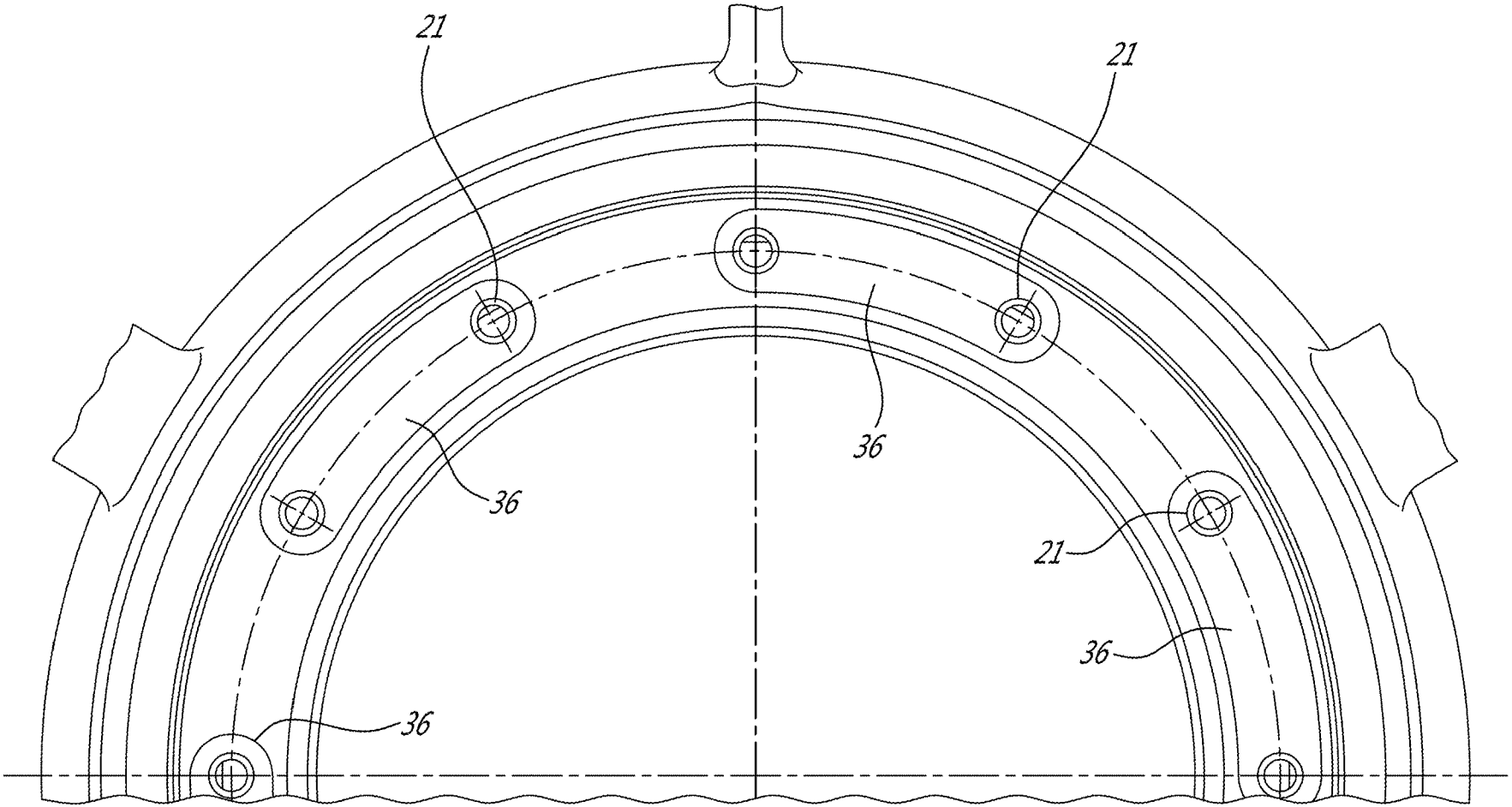
FIG. 8 shows a further alternative where the spacer is provided in the form of a segmented ring with a sacrificial series of segments welded to the heads of two bolts to prevent rotation of the bolts.

Alternative anti-rotation devices can be used as shown in FIGS. 6-7 and 8. For example, the spacer 22 can be segmented and include individual spacer segments 36 (FIG. 8) that connect to two or three bolts 21 only. Also, the spacer can take the form of a U-shaped clip 37 (FIGS. 6-7) wrap around the adjacent curved surface of the exhaust case 13. The U-shaped clip 37 can be bonded with a fillet weld 23 to the bolt head 25 to prevent rotation.

It can be appreciated that at least some of the above described combinations of features provide for an inseparable flange assembly in a restrained area where a welded flange is not practicable. Furthermore, at least some of the embodiments allow for a frangible joint using welded fasteners, such as welded bolts, as a frangible element.

The above description and drawings describe a method for connecting the exhaust case 13 and the bearing housing 14 of a gas turbine engine. The spigot surfaces 34-35 and spigot surfaces 32-33 are press fit together with the multiple fastener axes 24 aligned. FIG. 2 shows an uppermost bolt 21 and axis 24 offset in order to ensure that assembly is performed without rotation of the parts. The bolts 21 are installed with each bolt 21 having a head 25 engaging the exhaust case 13, via the intermediary of a spacer ring 22 in the example. The bolt shank 26 extends through the through bore 28, and a threaded end 27 of each bolt 21 engages a threaded bore 29 of the bearing housing 14. The head 25 of each bolt 21 is rotated to connect the exhaust case 13 and bearing housing 14 to a sufficient torque. Thereafter, each head 25 of each bolt 21 is welded to the annular spacer 22 to prevent rotation. Accordingly the bolt 21 and spacer 22 are secured to the exhaust case 13 with a removable anti-rotation frangible connector. In the examples described, the frangible connector comprises a weld 23 between the head 25 of the bolt 21 and the spacer 22. The exhaust case 13 has an inner spigot surface 32 and an outer spigot surface 33 that engages an inner spigot surface 34 and an outer spigot surface 35 of the bearing housing 14.

Disassembling the exhaust case 13 and bearing housing 14 involves breaking or removing the frangible welds 23 connecting the spacer 22 to the head 25 of each bolt 21. Removing each bolt 25 is performed by rotating to disengage the threaded end 27 from the bearing housing 14. The spacer 22 is then removed. Bolts 21 and spacer 22 are discarded or recycled as sacrificial elements since they are damaged by the welds 23. Disengaging the exhaust case 13 from the bearing housing 14 is accomplished by axially translating the exhaust case 13 relative to the bearing housing 14 in a press if necessary.

In one aspect of the present disclosure, there is provided a method of assembling a frangible joint using bolts joined to a sacrificial part with anti-rotation welds, in particular for connecting an exhaust case and a bearing housing of a gas turbine engine.

The embodiments described in this document provide non-limiting examples of possible implementations of the present technology. Upon review of the present disclosure, a person of ordinary skill in the art will recognize that changes may be made to the embodiments described herein without departing from the scope of the present technology. For example, welding or mechanical fasteners can be used as anti-rotation devices. Bolts can be substituted by rivets, shoulder pins or the like. Yet further modifications could be implemented by a person of ordinary skill in the art in view of the present disclosure, which modifications would be within the scope of the present technology.

What is claimed is:

1. A turbine exhaust case assembly comprising:

an exhaust case extending circumferentially around a central axis, the exhaust case including a plurality of circumferentially spaced-apart struts;

a bearing housing mounted in the exhaust case;

at least one service tube extending radially through one of said plurality of circumferentially spaced-apart struts, the at least one service tube having a radially inner end brazed to the bearing housing;

a plurality of fasteners securing the bearing housing to the exhaust case;

a sacrificial part mounted between the plurality of fasteners and one of the bearing housing and the exhaust case; and at least one weld between the plurality of the fasteners and the sacrificial part, the at least one weld locking the fasteners against rotation.

2. The turbine exhaust case assembly according to claim 1, wherein the sacrificial part includes a spacer ring defining a plurality of bores in registry with corresponding bores defined in the exhaust case and the bearing housing for receiving said plurality of fasteners, and wherein the spacer is provided on an axially facing surface of the of the exhaust case opposite to the bearing housing.

3. The turbine exhaust case assembly according to claim 2, wherein the plurality of fasteners are tack welded to the spacer ring.

4. The turbine exhaust case assembly according to claim 2 further comprising a spigot joint between the exhaust case and the bearing housing, wherein the plurality of fasteners extends axially through the spigot joint, the plurality of fasteners including bolts each having a head and a shank extending from the head, the spacer being axially trapped between the head of each of the bolts and the exhaust case, and wherein the head of each of the bolts is directly welded to the spacer.

5. The turbine exhaust case assembly according to claim 4, wherein the bores defined in the exhaust case and the bearing housing extend through the spigot joint.

6. The turbine exhaust case assembly according to claim 5, wherein the spigot joint is a thigh fit spigot joint comprising an outer diameter surface on a radially inner flange of the exhaust case and an inner diameter surface on a radially outer flange of the bearing housing, the inner diameter surface on the radially outer flange mating with the outer diameter surface on the radially inner flange, and wherein the spigot joint further comprises an inner diameter surface on the radially inner flange of the exhaust case and an outer diameter surface on the radially outer flange of the bearing housing, the inner diameter surface on the radially inner flange mating with the outer diameter surface on the radially outer flange.

7. A turbine exhaust case assembly comprising:

an exhaust case extending circumferentially around a central axis, the exhaust case having a plurality of circumferentially spaced-apart struts and a radially inner flange having a plurality of through bores aligned on a plurality of fastener axes in a circumferentially spaced apart array;

a bearing housing having a plurality of threaded bores aligned on the fastener axes;

one or more service tubes extending radially through respective ones of the plurality of circumferentially spaced-apart struts, the one or more service tubes having a radially inner end brazed to the bearing housing;

a plurality of fasteners, each fastener having a head engaging the exhaust case, a shank extending through the through bore, and a threaded end engaging the threaded bore for connecting and disconnecting the exhaust case and the bearing housing when the head is rotated; and an anti-rotation device securing the head of each fastener to the exhaust case, the anti-rotation device including at least one weld on the head of each one of the plurality of fasteners.

8. The turbine exhaust case assembly according to claim 7 wherein the anti-rotation device comprises a sacrificial part having a plurality of holes aligned on the fastener axes, the head of each one of the plurality of fasteners welded to the sacrificial part.

9. The turbine exhaust case assembly according to claim 8 wherein the sacrificial part includes a spacer ring welded to the head of each fastener.

10. The turbine exhaust case assembly according to claim 7 wherein a spigot joint is provided between the exhaust case and the bearing housing, the spigot joint including inner and outer diameter mating surfaces on both the exhaust case and the bearing housing.

11. The turbine exhaust case assembly according to claim 8 wherein the sacrificial part comprises a plurality of spacer ring segments, each spacer ring segment welded to at least two adjacent ones of the plurality of fasteners.

12. A method for connecting an exhaust case and a bearing housing of a gas turbine engine, the method comprising:

positioning the bearing housing in the exhaust case using spigot connection, inserting a service tube through a hollow strut of the exhaust case, brazing an inner end of the service tube to the exhaust case, fastening the bearing housing to the exhaust case using a plurality of threaded fasteners, and securing the plurality of threaded fasteners against rotation.

13. The method according to claim 12 comprising:

before fastening, installing a sacrificial ring having a plurality of holes in registry with corresponding holes defined in the exhaust case and the bearing housing, and inserting the plurality of fasteners into the registering holes in the ring, the exhaust case and the bearing housing.

14. The method according to claim 13 comprising:

wherein securing the plurality of threaded fasteners against rotation comprises welding the sacrificial ring to a head of each of the plurality of threaded fasteners.

15. The method according to claim 14 wherein the frangible connector comprises tack welds between the head of the threaded fasteners and the sacrificial ring.

16. The method according to claim 12 wherein positioning comprises press fitting the exhaust case and the bearing housing together.

17. The method according to claim 14, wherein brazing an inner end of the service tube to the exhaust case includes:

temporarily maintaining the bearing housing and the exhaust case with a braze fixture to form a secured assembly, and placing the secured assembly in a braze furnace.

18. The method according to claim 17, further comprising removing the braze fixture prior to fastening the bearing housing to the exhaust case.

* * * * *